US007319826B2

(12) United States Patent
Shim

(10) Patent No.: US 7,319,826 B2
(45) Date of Patent: Jan. 15, 2008

(54) METHOD OF OPTIMIZING AMOUNT OF TONER OF ELECTROPHOTOGRAPHIC PRINTER

(75) Inventor: Woo-jung Shim, Suwon-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 283 days.

(21) Appl. No.: 11/126,252

(22) Filed: May 11, 2005

(65) Prior Publication Data

US 2006/0024070 A1 Feb. 2, 2006

(30) Foreign Application Priority Data

Jul. 27, 2004 (KR) ..... 10-2004-0058791

(51) Int. Cl.
*G03G 15/00* (2006.01)
*G03G 15/08* (2006.01)

(52) U.S. Cl. ..... 399/12; 399/24; 399/25; 399/53

(58) Field of Classification Search ..... 399/9, 399/12, 24, 25, 53, 49, 60, 61
See application file for complete search history.

(56) References Cited

U.S. PATENT DOCUMENTS 6,577,823 B2 * 6/2003 Matsuguma et al. ..... 399/26
6,708,008 B2 * 3/2004 Hayashida et al. ..... 399/66
6,763,200 B2 * 7/2004 Sakai et al. ..... 399/27

* cited by examiner

*Primary Examiner*—Hoang Ngo
(74) *Attorney, Agent, or Firm*—Roylance, Abrams, Berdo & Goodman, LLP

(57) ABSTRACT

A method of optimizing the amount of toner of an electrophotographic printer is provided. The method includes measuring a life span of the development roller in use. The speed of a development roller, which corresponds to the measured life span of the development roller, is calculated from a lookup table. The development roller speed is adjusted according to the calculated development roller speed.

16 Claims, 7 Drawing Sheets

METHOD OF OPTIMIZING AMOUNT OF TONER OF ELECTROPHOTOGRAPHIC PRINTER

CROSS-REFERENCE TO RELATED PATENT APPLICATIONS

This application claims the benefit under 35 U.S.C. § 119(a) of Korean Patent Application No. 10-2004-0058791, filed on Jul. 27, 2004, in the Korean Intellectual Property Office, the entire disclosure of which is hereby incorporated by reference.

BACKGROUND OF THE INVENTION

1. Field of the Invention

The present invention relates to an electrophotographic printer. More particularly, the present invention relates to a method of optimizing the amount of toner supplied from a toner cartridge to a photoconductor of an electrophotographic printer.

2. Description of the Related Art

Generally, electrophotographic printers are operated in the following manner. An exposure unit makes an electrostatic latent image that corresponds to an image signal onto a photoconductor. A toner is applied to the electrostatic latent image to form a toner image. The toner image is transferred and fused onto a printing medium, such as paper, envelopes, labels, and transparencies.

The electrophotographic printer includes a photoconductor, toner cartridges (designated as Y, C, M, K in FIG. 1), and an image transfer unit. An electrostatic latent image is formed on the photoconductor. The toner cartridges are spaced a predetermined distance apart from the photoconductor to supply toner to the electrostatic latent image to develop a toner image. The image transfer unit transfers the toner image from the photoconductor to a printing medium.

The toner cartridge containing the toner is detachably installed in a main body of the printer. Each of the toner cartridges includes an agitator for stirring the toner, a development roller for supplying the toner to the electrostatic latent image of the photoconductor, and a supply roller for supplying the toner to the development roller.

When the toner in the toner cartridge is completely spent, the toner cartridge is replaced with a new one. However, there are several problems with using the replaced toner cartridge.

First, toner density (toner per unit area, M/A [g/cm$^2$]) of the development roller increases in proportion to the number of the printing media that have been printed after replacing the toner cartridge with a new one. The toner density of the development roller increases as the development roller is used for a long time because of stresses exerted on the toner by an agitator roller and the supply roller, selection phenomena of preferentially developing small-sized particles of the toner, or decreases in specific charge of the toner.

The increase of the toner density of the development roller causes increase of scattered toner even though an image density sensor is used to control toner image density of the photoconductor.

Second, the increase of the toner density on the development roller increases the amount of the toner on the photoconductor. The density sensor reads the amount of the toner and a controller optimizes developing conditions to reduce toner density. However, when the toner density increases more than a critical value, the developing condition cannot be optimized by adjusting a developing high voltage. It is difficult to compensate the density by controlling the image density because the replacement of the toner cartridge increases toner density more than the developing condition controlling maintains a constant density.

The increase of scattered toner increases contamination in the printer and the scattered toner may contaminate an optical sensor, thereby reducing the performance of the sensor.

Third, the increase of toner density on the development roller increases toner consumption in proportion to the number of the printing media that have been printed. The increase of the toner consumption lowers the toner transferring efficiency to the printing medium and increases the toner required to print the same number of printing media, thereby increasing costs and decreasing the life span of the toner cartridge.

The above-mentioned problems also increase the size of the development unit, thereby increasing the size of a printer engine. Further, a larger waste toner collector is required or the waste toner collector has to be replaced frequently owing to the increase of the toner consumption.

Accordingly, a need exists for a electrophotographic printer that optimizes toner use to decrease costs and extend the life of toner cartridges.

SUMMARY OF THE INVENTION

The present invention provides a method of optimizing the amount of toner used by an electrophotographic printer to reduce toner scattering and contamination.

According to an aspect of the present invention, a method of optimizing the amount of toner used by an electrophotographic printer includes determining a point of time to change the speed of a development roller. A life span of the development roller in use is measured. A development roller speed is calculated, which corresponds to the measured life span from a lookup table. The development roller speed is adjusted according to the calculated development roller speed.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

Figure 1:
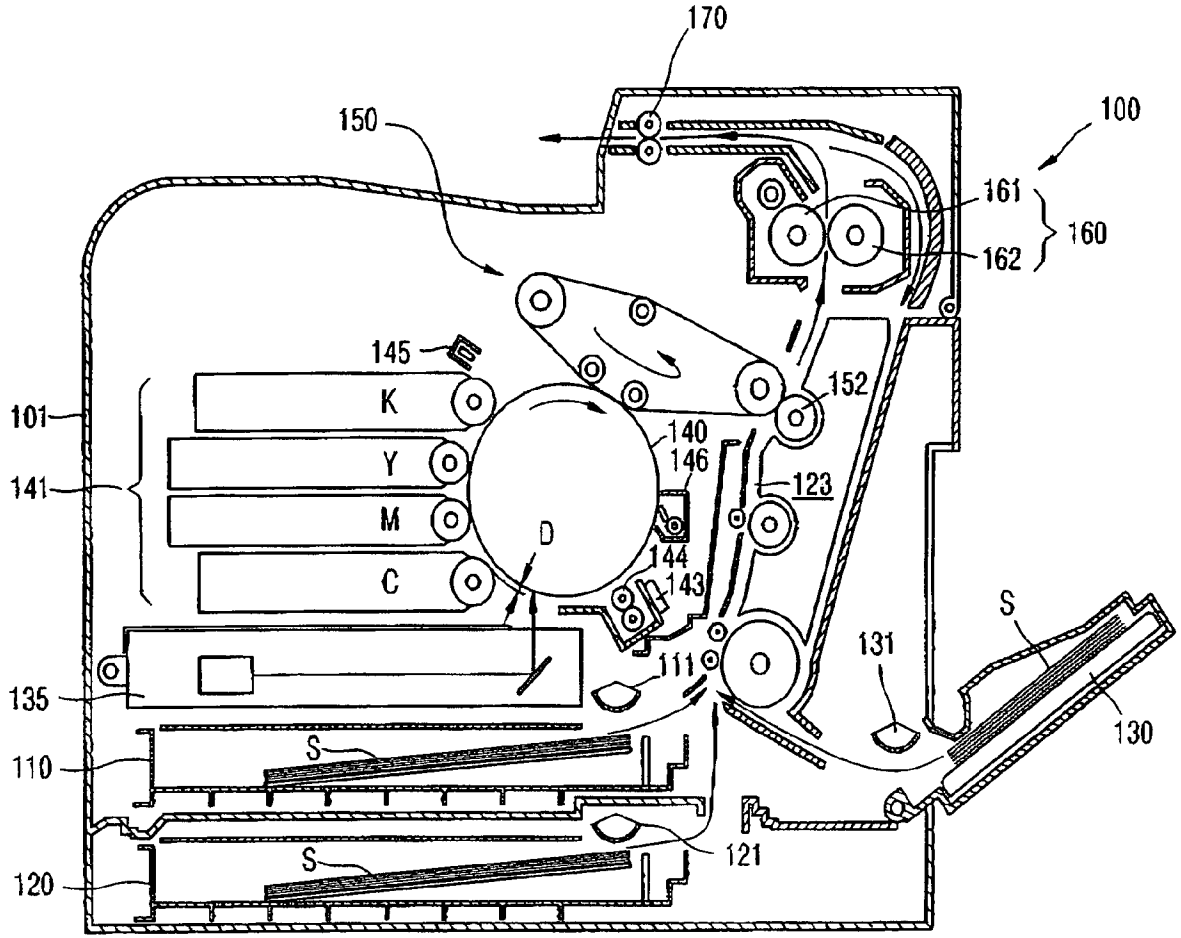
FIG. 1 is a side elevational view in partial cross section of an electrophotographic printer employing a method of optimizing the amount of toner according to an exemplary embodiment of the present invention.
Figure 2:
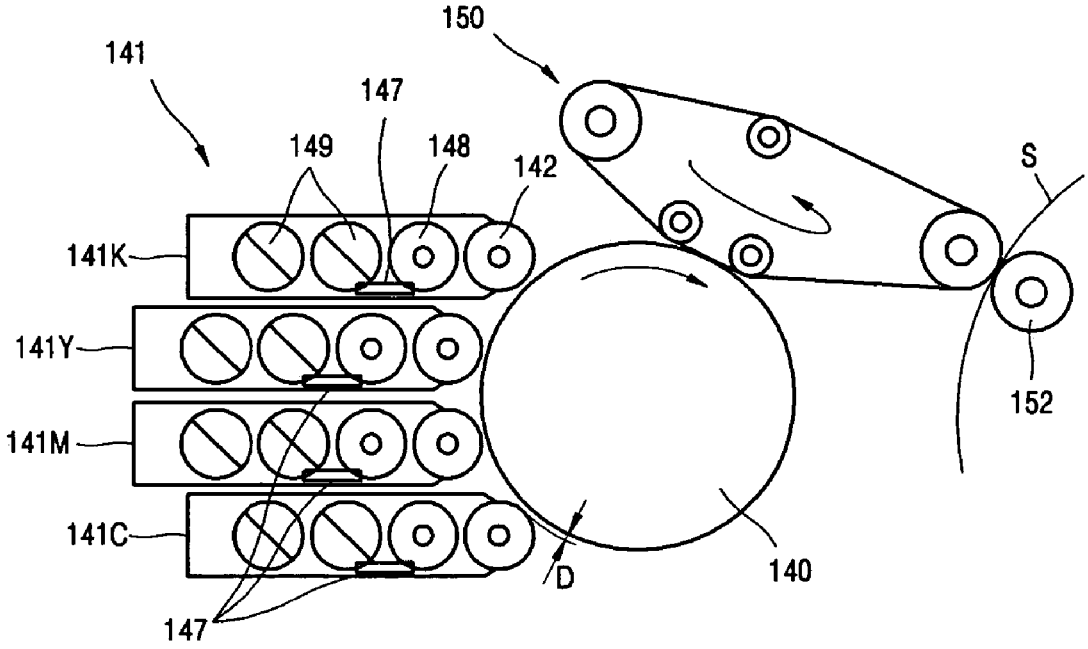
FIG. 2 is an enlarged elevational view of a photoconductive drum and transfer unit of FIG. 1.

Referring to FIGS. 1 and 2, an electrophotographic printer 100 includes a photoconductive drum 140, a development unit 141, a transfer unit 150, a transfer roller 152 and a fuser unit 160.

The printer 100 includes a plurality of cassettes 110 and 120 that are detachably installed at lower portions of a main body 101 to load printing media (S). Pick-up rollers 111 and 121 are installed above the cassettes 110 and 120 respectively, to pick up the printing media (S) one by one. The printer 100 also includes a multi-function feed tray 130 at a side portion. The feed tray 130 may be opened and closed by its swing motion. A pick-up roller 131 is also installed above the feed tray 130 to pick up the printing media (S) one by one. The printing media (S) is picked up by the pick-up rollers 111, 121 and 131 and conveyed along a convey passage 123. Toner images are printed on the printing media (S).

The photoconductive drum 140 is a metal drum of which an outer surface has a photoconductive material formed thereon. The photoconductive drum 140 is uniformly charged and then exposed to light corresponding to image data to form an electrostatic latent image on the outer surface of the photoconductive drum 140.

A charge roller 144 uniformly charges the photoconductive drum 140, and a laser beam emitter 135 emits the light corresponding to the image data. The charge roller 144 uniformly charges the outer surface of the photoconductive drum 140 while rotating in or out of contact with the photoconductive drum 140.

Before the charge roller 144 charges the photoconductive drum 140, a discharger 143 removes a residual charge from the outer surface of the photoconductive drum 140. The discharger 143 emits a light to the outer surface of the photoconductive drum 140 to remove the residual charge.

Before a toner image formed on the photoconductive drum 140 is transferred to the transfer unit 150, a pre-transfer eraser 145 removes a charge from a non-image zone of the photoconductive drum 140 to improve a transferring efficiency. The non-image zone is a portion where the toner image is not formed after the latent image is formed on the outer surface of the photoconductive drum 140.

A cleaner unit 146 removes a residual toner on the photoconductive drum 140 after the toner image is transferred to the transfer unit 150.

The development unit 141 includes black, yellow, magenta, and cyan toner cartridges 141K, 141Y, 141M and 141C. The toners of the toner cartridges 141K, 141Y, 141M, 141C are applied to the electrostatic latent image on the photoconductive drum 140 to make the toner image.

Each of the toner cartridges 141K, 141Y, 141M, and 141C includes a development roller 142 that is spaced away from the photoconductive drum 140 by a development gap D. A supply roller 148 supplies the toner to the development roller 142. A plurality of agitators 149 stir the toner.

Each of the toner cartridges 141K, 141Y, 141M, and 141C is provided with a memory 147 (CRUM, consumable replacement unit memory, or New Key) to check the life span of the development roller 142. The memory 147 stores the number of the printing media (S) or the number of image dots up to which the development roller 142 may be used and compares the stored medium (S) or dot number with measured medium (S) or dot number to calculate a printing speed of the development roller 142.

The transfer unit 150 transfers the toner image from the photoconductive drum 140 to the printing medium (S). A transfer belt is used with the transfer unit 150 in this embodiment.

The cyan (C), magenta (M), yellow (Y), and black (K) colors of the toner image on the photoconductive drum 140 are sequentially transferred and overlapped to the transfer unit 150 such that the color toner image may be formed on the transfer unit 150. The linear velocity of the transfer unit 150 is preferably equal to that of the photoconductive drum 140. The transfer unit 150 preferably has the same or a longer length than that of the printing medium (S) to which the color toner image is finally formed.

During the color image transfer from the photoconductive drum 140 to the transfer unit 150, the transfer roller 152 is spaced apart from the transfer unit 150. After the color image transfer from the photoconductive drum 140 to the transfer unit 150, the transfer roller 152 is engaged with the transfer unit 150 to transfer the color image from the transfer unit 150 to the printing medium (S).

The fuser unit 160 fuses the toner image to the printing medium (S). The fuser unit 160 includes a heating roller 161 and a pressure roller 162 for heating and pressing the printing medium (S) on which the toner image is transferred. The printing medium (S) is ejected through an eject roller 170 after the toner image is fused by the fuser unit 160.

The operation of the electrophotographic printer 100 having the above-mentioned construction is described below.

The multi-path type electrophotographic printer 100 uses the toner cartridges 141K, 141Y, 141M, and 141C to print a color image. Each of the yellow, cyan, magenta and black toners is separately applied onto the photoconductive drum 140 to develop a toner image from an electrostatic latent image. The toners applied on the photoconductive drum 140 are sequentially transferred and overlapped to the transfer unit 150 to form the toner image on the transfer unit. The toner image on the transfer unit 150 is transferred to the sheet S at a time to form the toner image on the printing medium (S). Therefore, the photoconductive drum 140 and the transfer unit 150 are rotated four revolutions to transfer one toner image to the printing medium (S).

The fuser unit 160 uses the heating roller 161 and the pressure roller 162 to heat and press the toner image transferred on the printing medium (S). The heated and pressed toner image adheres to the printing medium (S) and then the printing medium (S) is ejected by the eject roller 170.

A method of optimizing toner consumption according to an exemplary embodiment of the present invention is described below.

Figure 3:
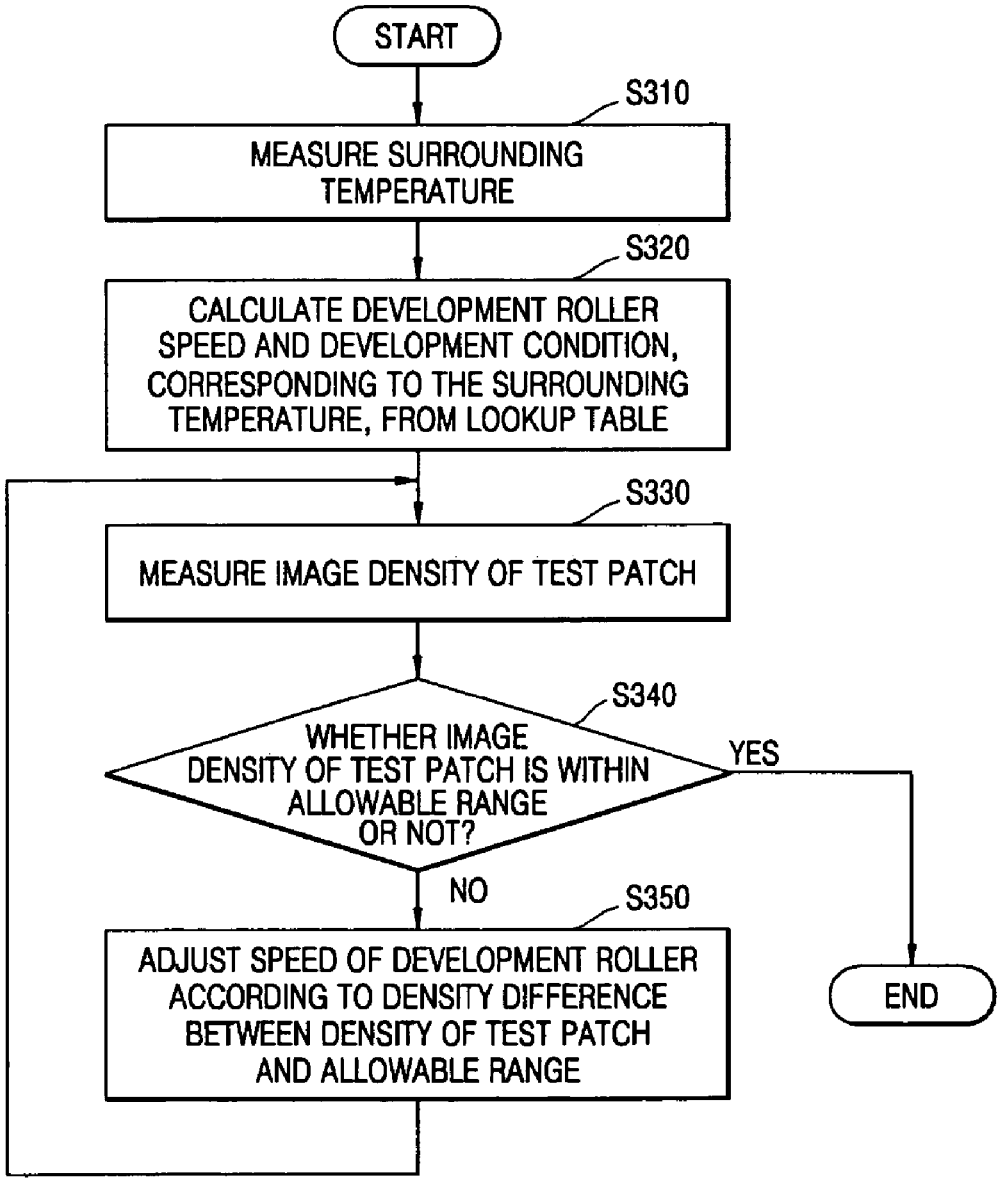
FIG. 3 is a flow chart showing speed adjustment of a development roller according to an image density of a test patch during an early stage of printing.

Referring to FIG. 3, a method is provided to print an image with a desired density. The method includes examining a test patch during operation to determine whether it is printed with a desired density, and adjusting the speed of the development roller 142 when the density of the test patch is out of a desired range.

A controller (not shown), to which each part is connected, collects data, analyses the data, and controls each part. Since typical controllers are well known, a description of the controller is omitted to provide a clear and concise description.

In operation S310 when the printer 100 is powered on, a surrounding temperature is measured with a temperature sensor (not shown) installed in the printer 100. In operation S320, a speed of the development roller 142 and a development condition that correspond to the measured temperature is calculated from a lookup table. The lookup table is previously stored with an optimized speed value of the development roller 142 and development condition with respect to the surrounding temperature.

In operation S330, a test patch is printed and an image density of the printed test patch is measured with a density sensor (not shown). In operation S340, the measured density of the test patch is evaluated to determine whether it is within an allowable range. In operation S350, if the measured density of the test patch is outside of the allowable range, the speed of the development roller 142 is adjusted according to the amount of density difference from the allowable range.

Since the image density of the test patch is mass per volume, the density is determined by the amount of transferred toner on the test patch. Therefore, since the image density of the test patch changes according to the amount of toner, the best image density corresponding to the surrounding temperature is accomplished by adjusting the speed of the development roller 142. The speed of the development roller 142 may be adjusted by controlling a variable device (not shown) capable of varying development roller motor speed.

The relationship between the amount of supplied toner and the speed of the development roller 142 may be denoted by the following equation:

[Equation 1]

The amount of toner$=\beta*V1>=\beta*V2$

Where, $\alpha$ and $\beta$ are proportional factors, V1 is linear velocity of the development roller, and V2 is linear velocity of the photoconductive drum.

To optimize the amount of toner, the toner must be supplied in such a manner that the product of $\beta$ and the linear velocity (V1) of the development roller 142 must be larger than or equal to that of $\alpha$ and the linear velocity (V2) of the photoconductive drum 140. The amount of toner is proportional to the linear velocity of the development roller 142. Therefore, if the amount of toner per unit area [M/A] of the development roller 142 becomes larger, it may be reduced by lowering the linear velocity (V1) of the development roller 142, thereby optimizing the amount of toner.

In operation S340, if the measured density of the test patch is within the allowable range, the flowchart ends.

Figure 4:
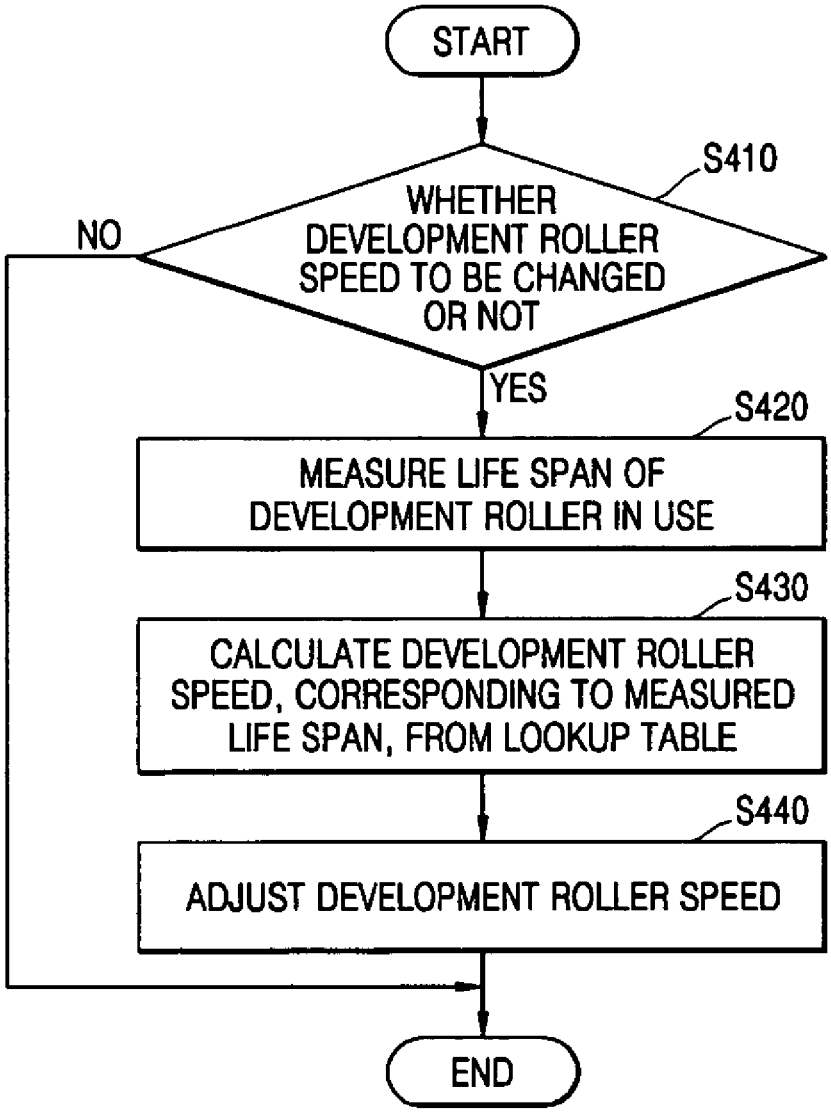
FIG. 4 is a flow chart showing speed adjustment for one development roller.

Referring to FIG. 4, since the amount of toner per unit area [M/A] of the development roller 142 increases in proportion to the number of the printing media (S) that have been printed when using a replaced cartridge, the velocity of the development roller 142 is adjusted by using the equation 1 in order to properly maintain the amount of toner. The flowchart shown in FIG. 4 is for a mono-image print that uses one toner cartridge.

In operation S410, a point of time to change a speed of the development roller 142 is determined. The determination of the point of time is performed each time when a predetermined number of the printing media (S) are printed. When a predetermined number of the printing media (S) are printed after replacing an old cartridge with a new cartridge, it is examined whether the speed of the development roller 142 is to be changed or not.

If the speed of the development roller 142 is required to be changed, the flowchart moves to operation S420. In operation S420, an in-use time of the development roller 142 is measured by counting printed numbers of the printing medium (S) or total printed numbers of the dots in the memory 147 (CRUM or New key).

In operation S430, the speed of the development roller 142, which corresponds to the measured in-use time, is calculated from the lookup table. In operation S 440, the speed of the development roller 142 is adjusted according to the speed calculated from the lookup table. The speed of the development roller 142 is adjusted in substantially the same manner as previously described. In operation S410, if the speed of the development roller 142 is not required to change, the flowchart ends.

Figure 5:
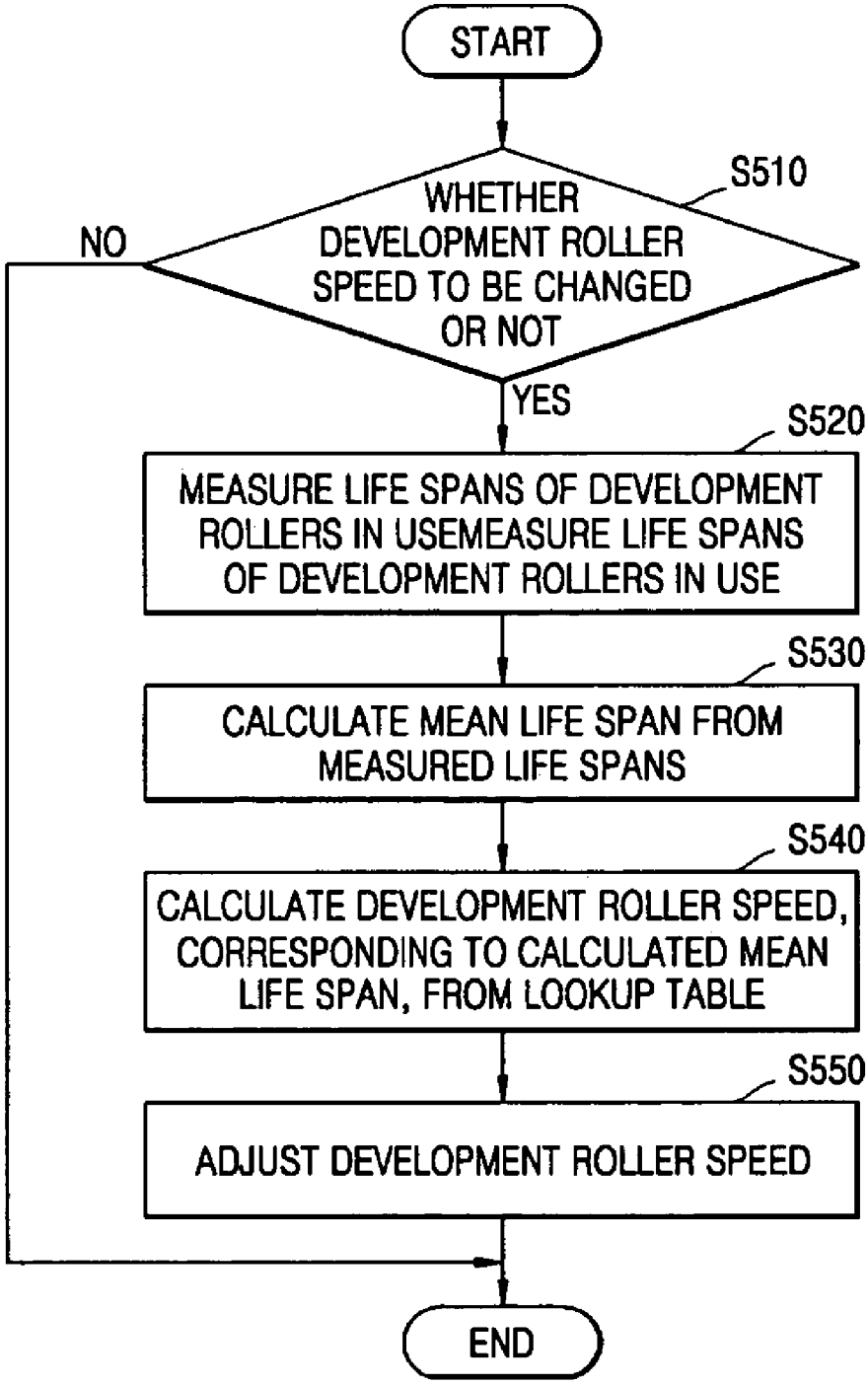
FIG. 5 is a flow chart showing speed adjustment for a plurality of development rollers when printing a color image.
Figure 6:
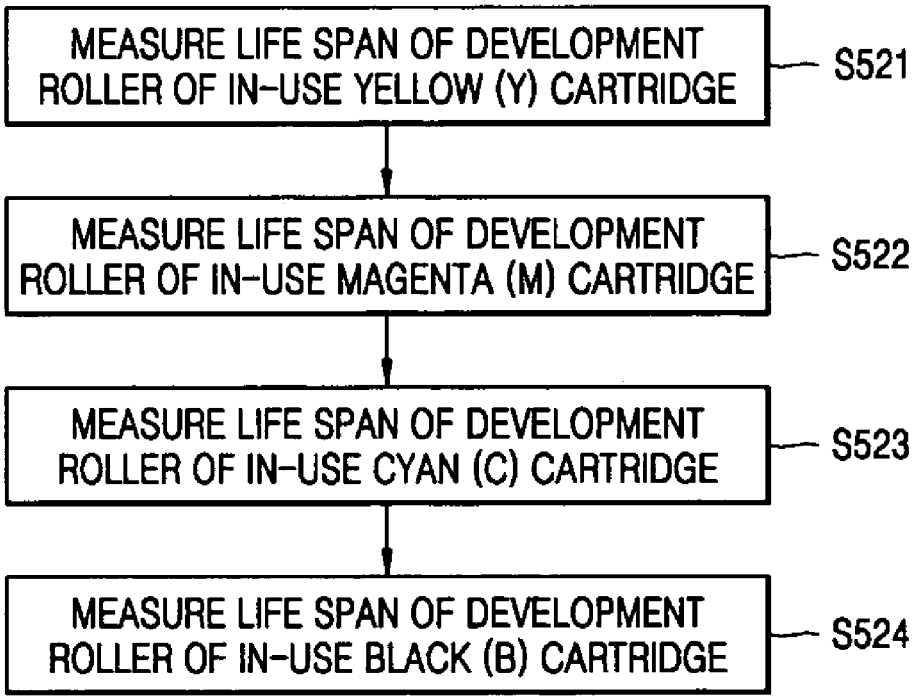
FIG. 6 is a flow chart showing measurement of real life spans of a plurality of development rollers depicted in FIG. 5.

Referring to FIGS. 5 and 6, when using the plurality of cartridges, such as yellow, cyan, magenta and black toner cartridges to print a color image, each toner cartridge is not consumed equally. Therefore, a mean value calculated from measured in-use times of the toner cartridges is used in place of the measured in-use time of each individual toner cartridge.

In operation S510, a point of time to change a speed of the development roller 142 is determined. In operation S520, each life span of the plurality of the development rollers 142 is measured. That is, the life span of the yellow toner cartridge 141Y is measured (S521), the life span of the magenta toner cartridge 141M is measured (S522), the life span of the cyan toner cartridge 141C is measured (S523), and the life span of the black toner cartridge 141K is measured (S524). The measurement of the life spans of the development rollers 142 are performed by counting printed numbers of the printing media (S) or printed numbers of total dots stored in the memory 147 (CRUM or New key).

In operation S530, a mean life span is calculated from the measured life spans of the plurality of the toner cartridges 141, with a typical method of calculating mean value.

In operation S540, a speed of the development roller 142 corresponding to the mean life span of the development roller is determined from the lookup table. In operation S550, the speed of the development roller 142 is adjusted according to the determined speed from the lookup table. The development roller speed is adjusted in substantially the same manner as described above. In operation S510, if the speed of the development roller 142 is not required to change, the flowchart ends.

Figure 7:
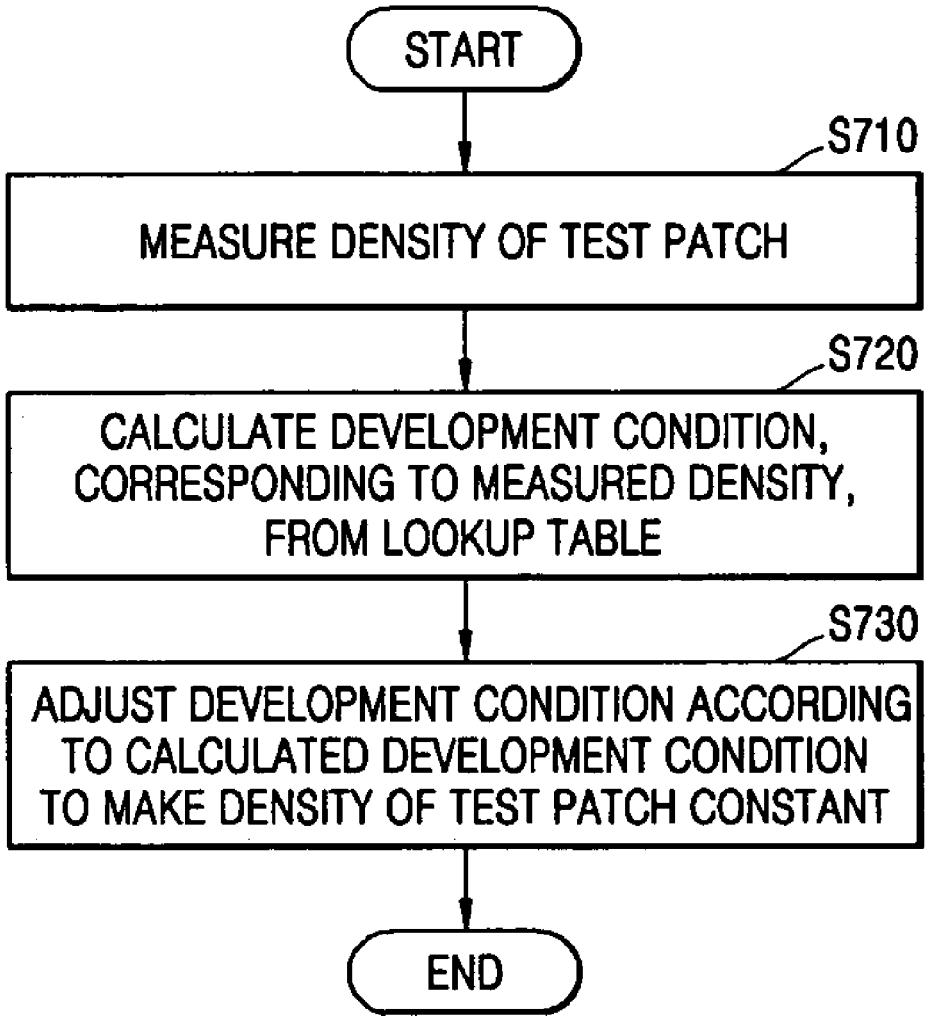
FIG. 7 is a flow chart showing an adjustment of development condition by measuring a density of a test patch.

FIG. 7 is a flow chart showing a method of measuring density of a test patch and adjusting developing conditions accordingly.

Referring to FIG. 7, to evaluate whether the image printing process consumes a proper amount of toner while operating the development roller 142 according to the adjusted speed after the flow shown in FIGS. 4 and 5 is completed, a test patch is printed and the density of the printed test patch is measured. If the measured density of the test patch is outside of allowable range, the density is adjusted to optimize the amount of toner.

In operation S710, the speed of the development roller 142 is adjusted, the test patch is printed and the density of the test patch is measured. In operation S720, a developing condition corresponding to the measured density is determined from the lookup table. In operation S730, the development roller 142 is adjusted to print the test patch with a substantially constant density according to the developing condition determined from the lookup table.

As described above, there are several advantages in the method of optimizing the amount of toner of the electrophotographic printer according to the present invention.

First, the amount of toner supplied to the development roller is optimized such that the scattering of toner may be reduced, thereby substantially preventing contamination in the printer.

Second, the consumption of the toner is reduced by optimizing the amount of toner supplied to the development roller, thereby reducing costs.

Third, the toner cartridge may be made with a compact shape by optimizing the amount of the toner in the toner cartridge.

Fourth, the replacement times of the waste toner collector is reduced by the reduced toner consumption, thereby extending the life span of the toner cartridges.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of optimizing the amount of toner of an electrophotographic printer, comprising the steps of determining when to change a speed of a development roller;

measuring a life span of the development roller in use;

calculating the speed of the development roller, which corresponds to the measured life span, from a lookup table; and adjusting the development roller speed according to the calculated development roller speed.

2. The method of claim 1, wherein the measuring the life span step further comprises measuring life spans of a plurality of in-use development rollers when developing a color image with a plurality of colors; and calculating a mean life span from the measured life spans of each of the plurality of in-use development rollers.

3. The method of claim 2, wherein the measuring the life span further comprises measuring the number of printing media that have been printed or the total number of printed image dots on the printing media.

4. The method of claim 3, further comprising disposing each of the development rollers in one of a plurality of toner cartridges.

5. The method of claim 4, further comprising storing toner cartridge information in a memory stored in each of the plurality of toner cartridges.

6. The method of claim 3, further comprising storing a total number of printable media and a total number of printable dots in the memory of each of the plurality of toner cartridges.

7. The method of claim 5, further comprising measuring the number of printing media that have been printed and comparing to the total number of printable media.

8. The method of claim 5, further comprising measuring the number of dots printed on the printing media and comparing to the total number of printable dots.

9. The method of claim 5, further comprising storing the lookup table in each of the memories of each of the toner cartridges.

10. A method of optimizing the amount of toner of an electrophotographic printer, comprising:

measuring a surrounding temperature;

calculating a speed of a development roller and a developing condition from a lookup table, the development roller speed and the developing condition corresponding to the surrounding temperature;

measuring an image density of a test patch;

evaluating whether the image density of the test patch is within an allowable range; and adjusting the development roller speed when the image density is outside of the allowable range.

11. The method of claim 1, further comprising before the step of determining when to change the speed of the development roller measuring a surrounding temperature;

calculating a speed of a development roller and a developing condition from a lookup table, the development roller speed and the developing condition corresponding to the surrounding temperature;

measuring an image density of a test patch;

evaluating whether the image density of the test patch is within an allowable range; and adjusting the development roller speed when the image density is outside of the allowable range.

12. The method of claim 1, further comprising afier the step of adjusting the development roller speed:

measuring a density of a test.patch;

calculating a developing condition corresponding to the measured density from the lookup table; and adjusting the developing condition according to the calculated developing condition to maintain the density of the test patch substantially constant.

13. The method of claim 10, further comprising adjusting the speed of the development roller based on the difference between the measured test patch density and the allowable density range.

14. The method of claim 10, further comprising disposing the development roller in a toner cartridge.

15. The method of claim 14, further comprising storing toner cartridge information in a memory stored in the toner cartridge.

16. The method of claim 15, further comprising storing the lookup table in the memory of the toner cartridge.

* * * * *